US010166645B2

(12) United States Patent
Sasakura et al.

(10) Patent No.: US 10,166,645 B2
(45) Date of Patent: Jan. 1, 2019

(54) CENTERLESS GRINDING MACHINE

(71) Applicant: KOYO MACHINE INDUSTRIES CO., LTD., Yao-shi, Osaka (JP)

(72) Inventors: Shizuki Sasakura, Yao (JP); Naohiko Wakayama, Yao (JP)

(73) Assignee: KOYO MACHINE INDUSTRIES COMPANY LIMITED, Osaka (JP)

( * ) Notice: Subject to any disclaimer, the term of this patent is extended or adjusted under 35 U.S.C. 154(b) by 46 days.

(21) Appl. No.: 15/293,752

(22) Filed: Oct. 14, 2016

(65) Prior Publication Data

US 2017/0106488 A1 Apr. 20, 2017

(30) Foreign Application Priority Data

Oct. 16, 2015 (JP) ..... 2015-204562

(51) Int. Cl.

| | |
|---|---|
| ***B24B 5/26*** | (2006.01) |
| ***B24B 53/007*** | (2006.01) |
| ***B24B 51/00*** | (2006.01) |
| ***B24B 53/04*** | (2012.01) |
| ***B24B 41/02*** | (2006.01) |

(Continued)

(52) U.S. Cl.

CPC ..... *B24B 5/26* (2013.01); *B24B 5/22* (2013.01); *B24B 41/02* (2013.01); *B24B 51/00* (2013.01); *B24B 53/003* (2013.01); *B24B 53/007* (2013.01); *B24B 53/04* (2013.01); *B24B 53/047* (2013.01); *B24B 53/053* (2013.01); *B24B 49/18* (2013.01)

(58) Field of Classification Search

CPC .... B24B 5/18; B24B 5/22; B24B 5/26; B24B 5/30; B24B 5/307; B24B 41/062; B24B 49/18; B24B 51/00; B24B 53/00; B24B 53/003; B24B 53/005; B24B 53/007; B24B 53/04; B24B 53/047; B24B 53/053; B24B 53/095

See application file for complete search history.

(56) References Cited

U.S. PATENT DOCUMENTS 6,123,605 A * 9/2000 Yano ..... B24B 53/053 451/243
6,312,318 B1 * 11/2001 Mushardt ..... B24B 5/24 451/177

(Continued)

FOREIGN PATENT DOCUMENTS

JP 2002-370143 A 12/2002
JP 2004-114179 A 4/2004

(Continued)

*Primary Examiner* — Timothy V Eley
(74) *Attorney, Agent, or Firm* — Cheng Law Group, PLLC

(57) ABSTRACT

A space-saving centerless grinding machine having high operability is obtained by devising the configuration of component units around the basic configuration of the machine. A dressing means for performing a dressing process for a grinding wheel and a regulating wheel comprises a single dressing unit. The dressing unit is located at a lower position between the grinding wheel and the regulating wheel, and thus eliminates the need for right and left dresser spaces for grinding wheels that have most seriously affected the breadthwise dimension of a conventional centerless grinding machine, leading to space saving and a considerable reduction in the breadthwise dimension of the centerless grinding machine.

9 Claims, 7 Drawing Sheets

(51) Int. Cl.

| | |
|---|---|
| ***B24B 53/00*** | (2006.01) |
| ***B24B 53/047*** | (2006.01) |
| ***B24B 53/053*** | (2006.01) |
| ***B24B 5/22*** | (2006.01) |
| *B24B 49/18* | (2006.01) |

(56) References Cited

U.S. PATENT DOCUMENTS

| | | | | |
|---|---|---|---|---|
| 6,569,000 | B1 * | 5/2003 | Mushardt | B24B 5/18 451/243 |
| 8,579,680 | B2 * | 11/2013 | Schellenberg | B24B 5/18 451/242 |
| 2010/0323589 | A1 * | 12/2010 | Schellenberg | B24B 5/18 451/259 |
| 2016/0107285 | A1 * | 4/2016 | Bahr | B24B 41/02 451/242 |

FOREIGN PATENT DOCUMENTS

| | | | |
|---|---|---|---|
| JP | 2004-216518 | A | 8/2004 |
| JP | 2006-123132 | A | 5/2006 |
| JP | 2007-190616 | A | 8/2007 |

* cited by examiner

CENTERLESS GRINDING MACHINE

BACKGROUND OF THE INVENTION

Field of the Invention

The present invention relates to a centerless grinding machine and more particularly to a centerless grinding machine suited to be used in a small installation space in particular.

Description of the Related Art

A centerless grinding machine is, as shown in FIG. 7, basically configured in that the periphery of work piece (hereinafter called work) W is ground by grinding wheel (c) rotationally driven while work W is rotationally supported by regulating wheel (a) and blade (b), and the regulating wheel (a) and the grinding wheel (c) are disposed opposite to each other at either side of work W (refer to Japanese Laid-Open Patent 2004-114179).

Also, the regulating wheel (a) and the grinding wheel (c) are respectively provided with dressing units (d), (e) for dressing the grinding surface, and both of dressing units (d), (e) are disposed at the right and left sides of the regulating wheel (a) and the grinding wheel (c) in FIG. 7.

Such a configuration of centerless grinding machine is typically employed for all types of centerless grinding machines irrespective of the shapes and dimensions of relevant work W and the levels of grinding force applied to work W. Such a configuration causes various problems, which will be discussed below, and requires a relatively large installation space, interfering with size reduction and space saving of the centerless grinding machine.

(i) Also in alignment of dressing units (d), (e) with grinding wheel (c) and regulating wheel (a), these components (a), (c), (d), (e) are moved in a lateral direction (a vertical direction in FIG. 7) of the grinding machine and a sub operation panel other than an operation panel needs to be used.

(ii) The center height of work W is adjusted by changing the thickness of a spacer interposed between blade (b) and work rest (not shown) supporting blade (b), with reference to previous grinding results.

(iii) The amounts of diamond movement of dressing units (d), (e) relative to grinding wheel (c) and regulating wheel (a) are calculated from the outside diameter of work W, the outside diameters of grinding wheel (c) and regulating wheel (a), and the center heights of grinding wheel (c) and regulating wheel (a). The amounts are manually adjusted.

(iv) Generally, a coolant tank is separated from a grinding machine, which is not specifically illustrated. This restricts a reduction of the installation space of the centerless grinding machine.

In this respect, as disclosed in, for example, Japanese Laid-Open Patent 2002-370143, Japanese Laid-Open Patent 2004-216518, Japanese Laid-Open Patent 2006-123132, and Japanese Laid-Open Patent 2007-190616, various configurations have been proposed for downsizing of centerless grinding machines which are not specifically illustrated. These configurations need to be further improved to drastically solve the problems.

BRIEF SUMMARY OF THE INVENTION

The main object of the present invention is to provide a novel centerless grinding machine which has solved such conventional problems.

Another object of the invention is to provide a space-saving centerless grinding machine with high operability by devising the configuration of component units around the basic configuration of the grinding machine.

A centerless grinding machine according to the present invention is configured in that centerless grinding is executed on the periphery of a work by means of a grinding wheel rotationally driven while the work is rotationally supported by a regulating wheel and a blade, and a dressing means for performing a dressing process of the grinding wheel and the regulating wheel comprises a single dressing unit. The dressing unit is disposed at a lower position between the grinding wheel and the regulating wheel.

As a preferred embodiment, the following configuration is employed:

(1) A grinding wheel spindle case pivotally supports the grinding wheel so as to rotationally drive the grinding wheel and a regulating wheel spindle case pivotally supports the regulating wheel so as to rotationally drive the regulating wheel. The grinding wheel spindle case and the regulating wheel spindle case are disposed on a bed so as to move at least in a lateral feeding direction via a grinding wheel sliding unit and a regulating wheel sliding unit, respectively, the bed being disposed on a machine pedestal.

(2) The dressing unit is disposed at a front lower position between the grinding wheel and the regulating wheel, the dressing unit including a dresser disposed so as to vertically move between a standby position and a dressing position, the dresser being moved in a longitudinal axial direction relative to the grinding wheel and the regulating wheel so as to dress the grinding wheel and the regulating wheel at the dressing position.

(3) The grinding wheel spindle case and the regulating wheel spindle case are disposed on the bed so as to move in the longitudinal axial direction and the lateral feeding direction via the grinding wheel sliding unit and the regulating wheel sliding unit, respectively, the bed being disposed on the machine pedestal, and the dresser of the dressing unit dresses the grinding wheel and the regulating wheel at the dressing position along with cooperation with a movement of the grinding wheel and the regulating wheel in the longitudinal axial direction.

(4) The dressing unit is disposed on a vertical slide with a blade supporting a work, at a lower position between the grinding wheel and the regulating wheel, the vertical slide being capable of vertically reciprocating relative to the bed so as to vertically move the dresser of the dressing unit.

(5) The dressing unit includes a dresser shaft that is slanted with respect to the axes of the grinding wheel and the regulating wheel. The dresser shaft has a grinding wheel dresser that dresses the grinding wheel, and a regulating wheel dresser that dresses the regulating wheel. The grinding wheel dresser and the regulating wheel dresser are located without interfering with a dressing operation each other.

(6) A coolant tank for supplying and collecting coolant to and from a grinding section has the function of a part of a local cover that covers the grinding section.

(7) The grinding wheel and the regulating wheel that constitute the grinding section are disposed like an overhang from the grinding wheel spindle case, the regulating wheel spindle case and the vertical slide in one direction, and the grinding section in contact with grinding or processing coolant is covered with the local cover so as to be limited and isolated.

(8) The machine pedestal has a control device for controlling by mutually interlocking the drive sources of the components of the grinding machine.

A centerless grinding machine according to the present invention is configured in that centerless grinding is executed on the periphery of a work by means of a grinding wheel rotationally driven while the work is rotationally supported by a regulating wheel and a blade, and the dressing means for performing the dressing process of the grinding wheel and the regulating wheel comprises a single dressing unit. The dressing unit is disposed at a lower position between the grinding wheel and the regulating wheel. Thus, a space-saving centerless grinding machine having high operability can be provided so as to achieve various unique effects as follows:

(a) The dressing means for performing the dressing process of the grinding wheel and the regulating wheel comprises the single dressing unit. The dressing unit is located at a lower position between the grinding wheel and the regulating wheel, and thus eliminates the need for right and left dresser spaces for grinding wheels that have most seriously affected the breadthwise dimension of a conventional centerless grinding machine, leading to space saving and a considerable reduction in the breadthwise dimension of the centerless grinding machine.

This configuration is suitably used in a small installation space and particularly makes it possible to provide a small desktop centerless grinding machine that can be installed in quite a small installation space, for example, on an office desk.

(b) The dressing unit is disposed at a lower position between the grinding wheel and the regulating wheel so as to dress the grinding wheel and the regulating wheel at the grinding position of the work. This suppresses a change in dimensions caused by a thermal displacement during the grinding of the grinding wheel and the regulating wheel, thereby improving grinding accuracy.

Specifically, if the position of dressing performed by the dressing unit on the grinding wheel and the regulating wheel is separated or different from the position of grinding performed by the grinding wheel and the regulating wheel on the work, a grinding or processing environment (particularly an ambient temperature) during dressing on the grinding wheel and the regulating wheel is different from a grinding or processing environment during an operation of the grinding wheel and the regulating wheel, that is, during grinding. Consequently, predetermined shape and size of the grinding wheel and the regulating wheel dressed by the dressing unit are affected by a change in dimensions caused by a thermal displacement during actual grinding, thereby reducing grinding accuracy.

Thus, according to the present invention, the grinding wheel and the regulating wheel are dressed at the grinding position of the work, so that a grinding or processing environment during dressing can be identical to that, during grinding. Consequently, predetermined shape and size of the grinding wheel and the regulating wheel dressed by the dressing unit are not affected by a change in dimensions caused by a thermal displacement during actual grinding, thereby keeping desired grinding accuracy.

(c) The dressing unit is disposed on the vertical slide with the blade supporting the work, at a lower position between the grinding wheel and the regulating wheel, and the vertical slide can vertically reciprocate relative to the bed. Thus, the operation of the vertical slide can be automatically controlled so as to adjust the center height of the work, which has been manually adjusted in the related art, and adjust the amount of dresser diamond movement of the dressing unit under numerical control. This can shorten a changeover time and achieve highly advanced changeover.

(d) The control device for controlling by mutually interlocking the drive sources of the components of the grinding machine is disposed in the machine pedestal and thus the control panel, which is disposed the outside of the apparatus in the conventional centerless grinding machine, can be installed in the space of the grinding machine (the inside of the apparatus).

(e) The coolant tank for supplying and collecting coolant to and from the grinding section has the function of a part of the local cover for covering the grinding section, and thus the coolant tank can be disposed in the space of the grinding machine.

(f) The control device and the coolant tank are stored in the space of the grinding machine, thereby reducing of the installation space, namely, space saving can be promoted.

(g) The grinding wheel and the regulating wheel that constitute the grinding section are disposed like an overhang in one direction (to the front direction) from the grinding wheel spindle case, the regulating wheel spindle case and the vertical slide, and are covered with the local cover for covering the grinding section. Thus, the grinding section in contact with grinding or processing coolant is limited and isolated into the grinding room.

Consequently, the mechanism section comprising the grinding wheel spindle case, the regulating wheel spindle case and the vertical slide, and the drive section including the motor are stored in a machine room isolated from the grinding room. Thus, coolant is unlikely to come in contact with the mechanism section and the drive section, thereby increasing the life of the machine and eliminating the need for a waterproof construction for the machine room. This leads to lower manufacturing cost and thus reduces the machine cost.

(h) The grinding wheel and the regulating wheel that constitute the grinding section are disposed like an overhang to the front direction from the grinding wheel spindle case, the regulating wheel spindle case, and the vertical slide, and the dressing unit is disposed at a lower position between the grinding wheel and the regulating wheel. Thus, all operations for grinding and dressing can be performed at the front of the grinding machine substantially without movements, thereby remarkably improving operability and preparation.

The above and other related objects and features of the present invention are obvious in the detailed description with reference to the drawings and the novel items mentioned in the claims.

DETAILED DESCRIPTION OF THE PREFERRED EMBODIMENT

Figure 1:
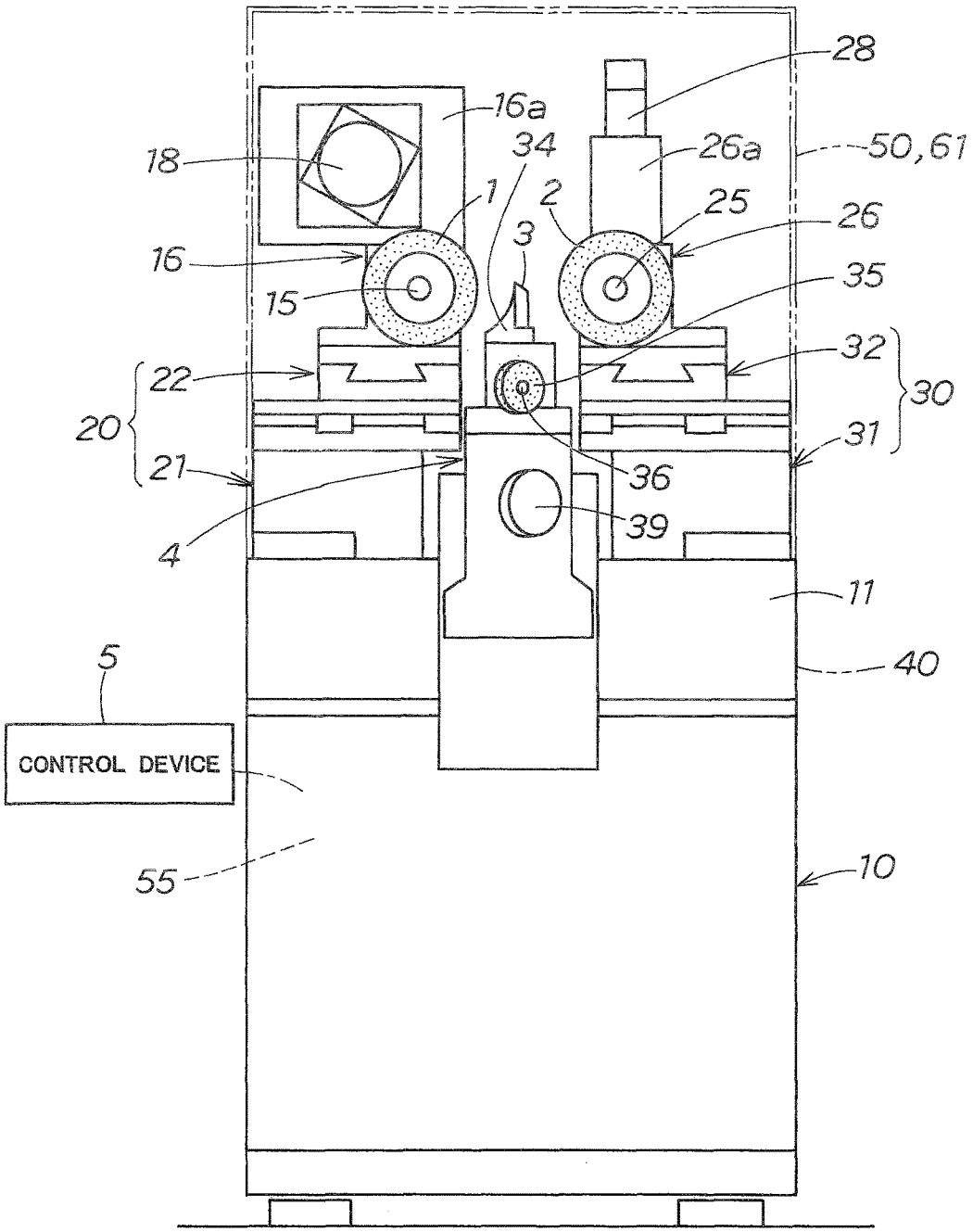
FIG. 1 is a front view showing the whole configuration of a centerless grinding machine in an embodiment of the present invention.

The embodiment of the present invention will be specifically described below with reference to the drawings. In the drawings, the same reference numerals stand for the same component members or elements.

FIGS. 1 to 6 show a centerless grinding machine of the present invention. The grinding machine is a small centerless grinding machine that includes a space-saving structure for executing centerless grinding of the periphery of work W. Specifically, the machine is configured with a desktop size mountable on an office desk or the like.

In the specific configuration of the grinding machine, main elements are grinding wheel 1, regulating wheel 2, blade 3, dressing unit 4 and control device 5. These main elements and peripheral elements each have a space-saving structure.

In the grinding machine, first, bed 11 is fixed on machine pedestal 10. Component units disposed on the bed 11 include grinding wheel spindle case 16 provided with the grinding wheel 1, regulating wheel spindle case 26 provided with the regulating wheel 2, the blade 3, and the dressing unit 4.

In the illustrated example, as shown in FIG. 1, the grinding wheel spindle case 16 is disposed at the left of the front of the machine while the regulating wheel spindle case 26 is disposed at the right of the front of the machine. The configuration may be reversed depending on the purpose.

The grinding surface (peripheral surface) of grinding wheel 1 has a profile corresponding to the final shape of work W or the final finish shape of the peripheral surface of work W, and the grinding wheel 1 is detachably fixed on the leading end of grinding wheel spindle 15 (cantilever structure), and the grinding wheel spindle 15 is disposed on grinding wheel spindle case 16 so as to rotate and drive.

The basic configuration of a driving system for grinding wheel 1 may be a conventionally known configuration. Specifically, the grinding wheel spindle 15 is pivotally and rotationally supported on grinding wheel spindle case 16 mounted on the bed 11, and the rear end of grinding wheel spindle 15 is brought into driving engagement with driving motor 18 via a driving transmission mechanism (not shown).

Figure 2:
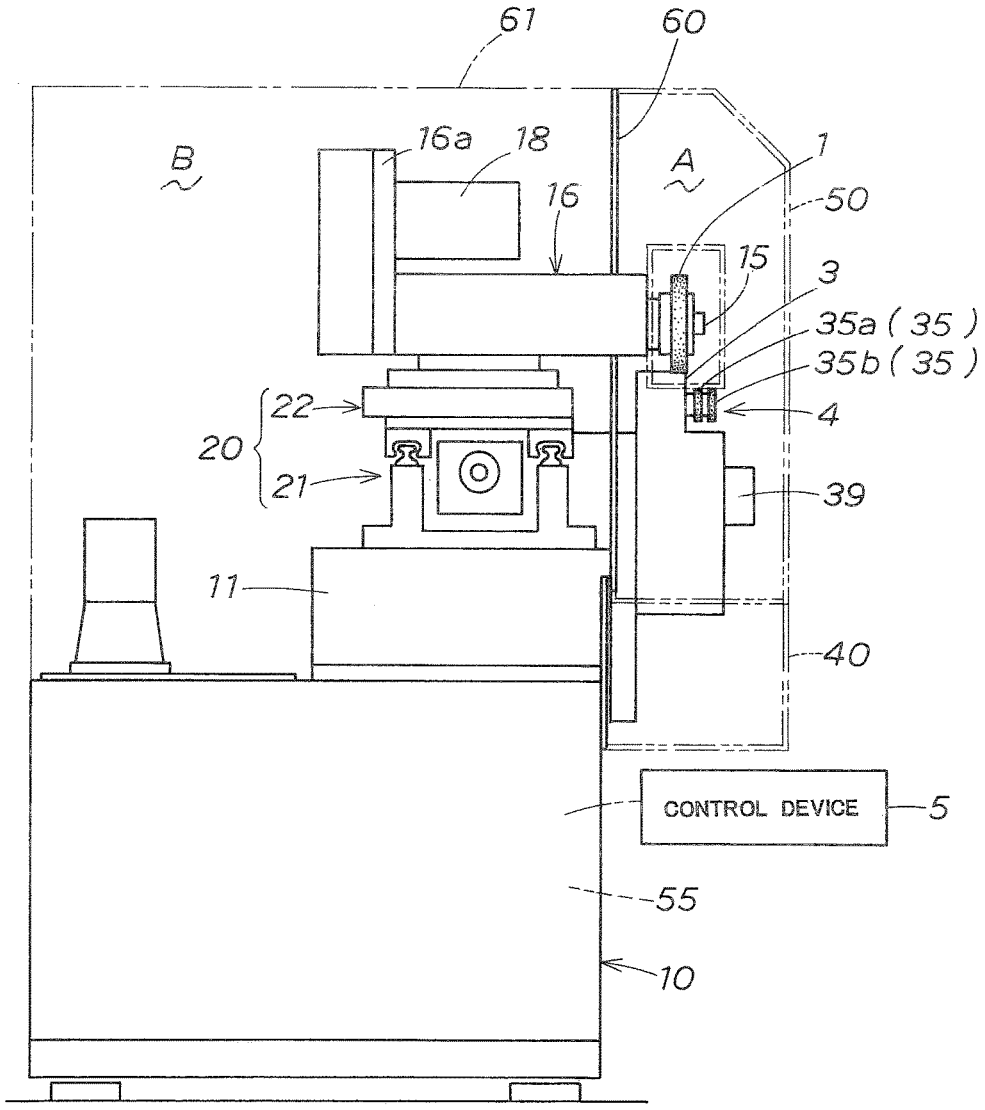
FIG. 2 is a side view showing the whole configuration of the centerless grinding machine.
Figure 3:
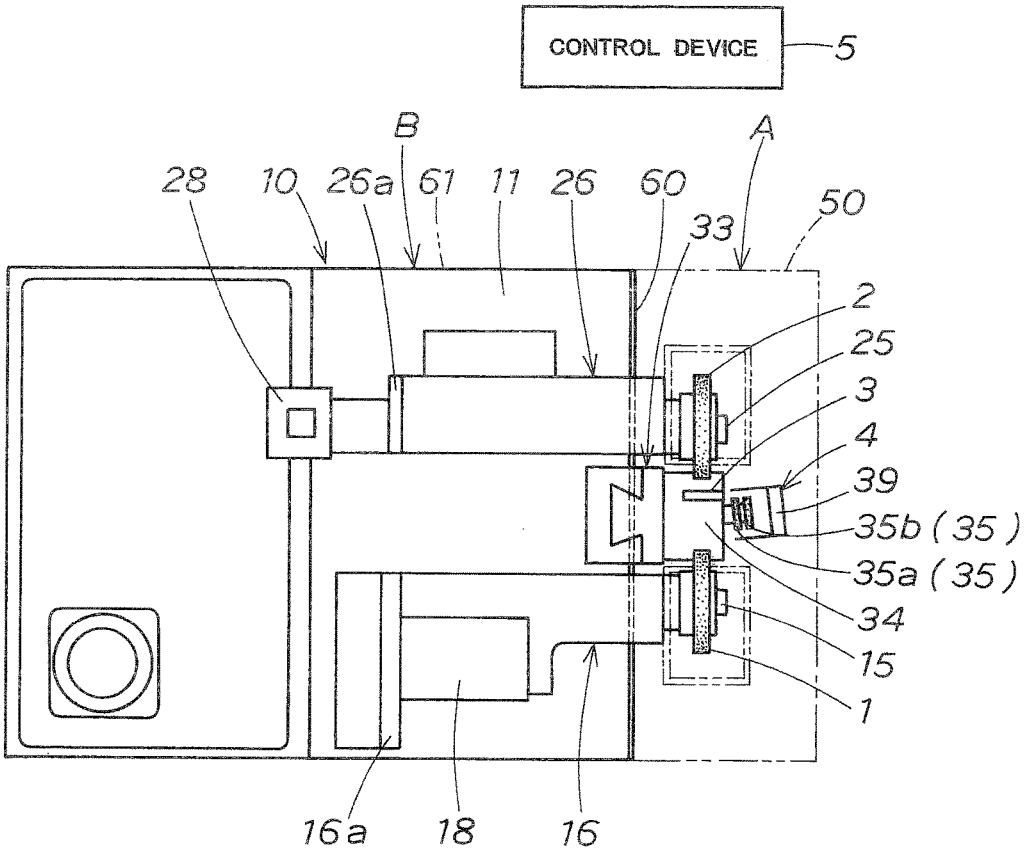
FIG. 3 is a plan view showing the whole configuration of the centerless grinding machine.

As shown in FIGS. 1 to 3, driving motor 18 of the illustrated embodiment is disposed in a horizontal state at the front side of raised part 16*a* of grinding wheel spindle case 16 and is electrically connected to the control device 5.

The driving motor 18 may be disposed at the rear side in place of the front side (as shown in the embodiment) of raised part 16*a* of grinding wheel spindle case 16 depending on the purpose. The driving motor 18 may also be mounted in any other state, e.g., in an upright state or an inverted state in place of a horizontal state (as shown in the embodiment) depending on the purpose.

Figure 4:
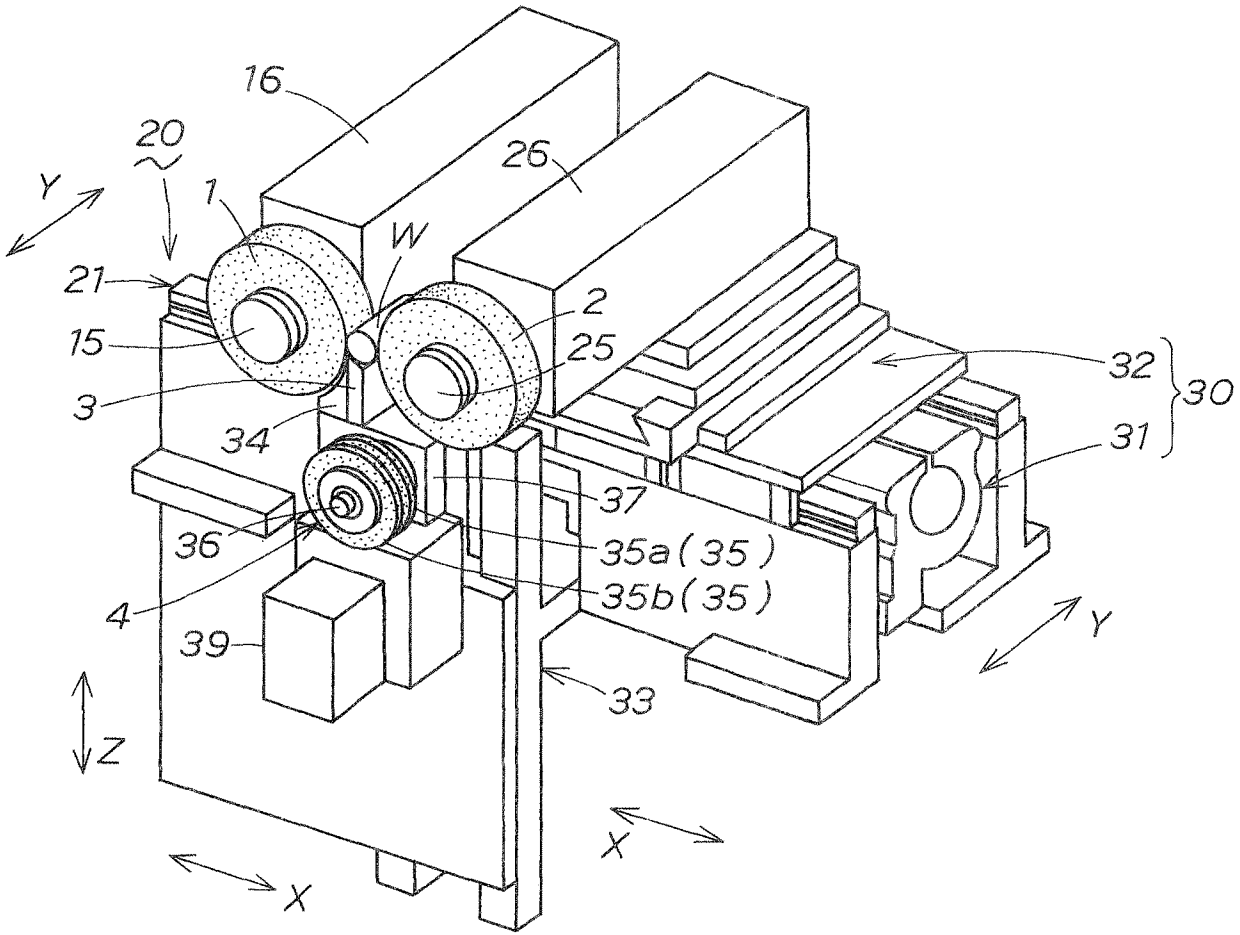
FIG. 4 is a perspective view showing the configuration of the main elements of the centerless grinding machine.

The grinding wheel spindle case 16 is movable at least in lateral feeding direction X on the bed 11 via grinding wheel sliding unit 20. In the illustrated embodiment, as shown in FIG. 4, grinding wheel spindle case 16 is movable in lateral feeding direction X and longitudinal axial direction Y (forward and backward).

In this case, lateral feeding direction X is a feeding direction of grinding wheel 1 to work, whereas longitudinal axial direction Y is the axial direction of grinding wheel 1 (and regulating wheel 2 and work W).

Specifically, grinding wheel sliding unit 20 comprises grinding wheel lateral slide 21 and grinding wheel longitudinal slide 22. Thus, grinding wheel spindle 15 can longitudinally and laterally move (forward and backward) along two orthogonal axes.

The feeding operations (advancing and retreating operations) of both slides 21, 22, although not shown specifically, are configured to perform a feeding operation by means of a feeding means disposed in the sliding unit, which comprises a guide unit, a feed screw unit and a driving motor acting as a drive source. The driving motor is electrically connected to the control device 5.

In the illustrated embodiment, grinding wheel lateral slide 21 is disposed on the bed 11 and the grinding wheel longitudinal slide 22 is disposed thereon. The configuration may be reversed depending on the purpose.

Regulating wheel 2 is for rotationally supporting the periphery of work W, and its rotationally supporting surface (peripheral surface) has a profile corresponding to the final shape of work W or the final finish shape of the peripheral surface of the work W. The regulating wheel 2 is detachably fixed on the leading end of regulating wheel spindle 25 (cantilever structure), and the regulating wheel spindle 25 is disposed on the regulating wheel spindle case 26 so as to rotate and drive.

Regulating wheel spindle 25 is desirably slightly slanted to obtain thrust in the axial direction of work W during grinding. The slant adjustment of regulating wheel spindle 25 is not specifically illustrated. A slant adjustment mechanism may be disposed on a part where regulating wheel spindle case 26 is installed to regulating wheel sliding unit 30, which will be described later, and regulating wheel spindle case 26 may be fixed to the regulating wheel sliding unit 30 while regulating wheel spindle 25 has a predetermined slant.

A conventionally known basic configuration may be used for the driving system of regulating wheel 2. Specifically, regulating wheel spindle 25 is pivotally and rotationally supported on regulating wheel spindle case 26 mounted on the bed 11, and the rear end of regulating wheel spindle 25 is brought into driving engagement with driving motor 28 via a driving transmission mechanism (not shown).

As shown in FIGS. 1 and 3, driving motor 28 of the illustrated embodiment is disposed on the rear side of the raised part 26*a* of the regulating wheel spindle case 26 in an inverted state and is electrically connected to the control device 5.

The driving motor 28 may be disposed at the front side in place of the rear side as shown in the embodiment of the raised part 26*a* of the regulating wheel spindle case 26 depending on the purpose. The driving motor 28 may also be mounted in any state, e.g., in an upright state or a horizontal state in place of an inverted state as shown in the embodiment depending on the purpose.

The structure in an inverted state in FIGS. 1 and 3 may be mounted in any position, e.g., in an upright state or a horizontal position depending on the purpose.

The regulating wheel spindle case 26 is movable at least in lateral feeding direction X on the bed 11 via regulating wheel sliding unit 30. In the illustrated embodiment, regulating wheel spindle case 26 is movable in lateral feeding direction X and longitudinal axial direction Y (forward and backward) like grinding wheel spindle case 16.

Specifically, the regulating wheel sliding unit 30 comprises regulating wheel lateral slide 31 and regulating wheel longitudinal slide 32. Thus, regulating wheel spindle 25 can longitudinally and laterally move (forward and backward) along two orthogonal axes.

The feeding operations (advancing and retreating operations) of both slides 31, 32, although not shown specifically, are configured to perform a feeding operation by means of a feeding means disposed in the sliding unit, which comprises a guide unit, a feed screw unit and a driving motor acting as a drive source. The driving motor is electrically connected to the control device 5.

In the illustrated embodiment, the regulating wheel lateral slide 31 is disposed on the bed 11 and the regulating wheel longitudinal slide 32 is disposed thereon. The configuration may be reversed depending on the purpose.

The grinding wheel lateral slide 21 and the regulating wheel lateral slide 31 are disposed on the bed 11 with a horizontally adjustable slant via a pivot (not shown) such that the regulating wheel spindle 25 and the grinding wheel spindle 15 can be set substantially in parallel with the blade 3 or at a predetermined angle with respect to the blade 3.

The slant adjustment structure including the pivot may be provided only for one of the grinding wheel lateral slide 21 and the regulating wheel lateral slide 31 depending on the purpose. Alternatively, such a slant adjustment structure may be omitted and a slant may be adjusted during the assembly of the machine.

The blade 3 is for supporting work W with regulating wheel 2 and is disposed on vertical slide 33, which serves as a support base, together with the dressing unit 4 as will be described later. Specifically, the blade 3 is fixed to work rest 34 mounted on the vertical slide 33.

The blade 3 linearly extends between the grinding wheel 1 and the regulating wheel 2. The upper end face of the blade 3 is a support surface slanted downwardly of the regulating wheel side.

Since the blade 3 is disposed on the vertical slide 33 so as to vertically move with the dressing unit 4, the center height of the work W can be automatically adjusted under numerical control as will be described later.

The dressing unit 4 serves as a dressing means that simultaneously or separately performs a dressing process of correcting (dressing) the shape of the peripheral grinding surface of the grinding wheel 1 and a dressing process of correcting (dressing) the shape of the peripheral grinding surface of the regulating wheel 2. The dressing unit 4 is disposed at a lower position between the grinding wheel 1 and the regulating wheel 2. In the illustrated embodiment, the dressing unit 4 is disposed at a front lower position between the grinding wheel 1 and the regulating wheel 2.

Dresser 35 of the dressing unit 4 is vertically movable between a standby position Po (FIG. 5A) located below the grinding wheel 1 and the regulating wheel 2 and a dressing position on the grinding wheel 1 and the regulating wheel 2, that is, an axial height Ph (FIG. 5B) of the grinding wheel 1 and the regulating wheel 2.

Figure 5A:
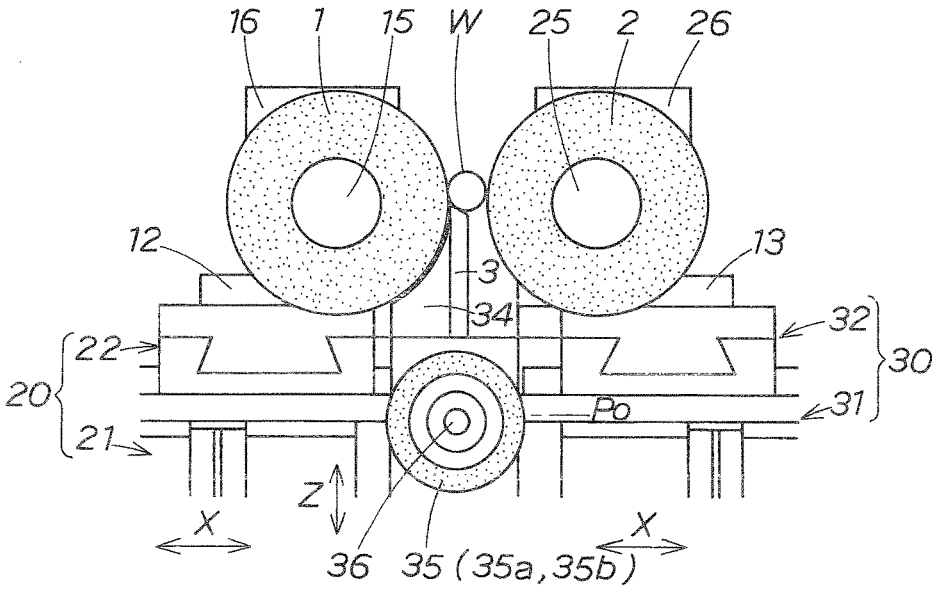
FIG. 5A is an enlarged front view showing a dressing unit of the centerless grinding machine in a standby state during grinding.

As shown in FIG. 5A, when the dresser 35 of the dressing unit 4 is placed at the standby position Po, the blade 3 is set at a height so as to support work W at a grinding position.

Figure 5B:
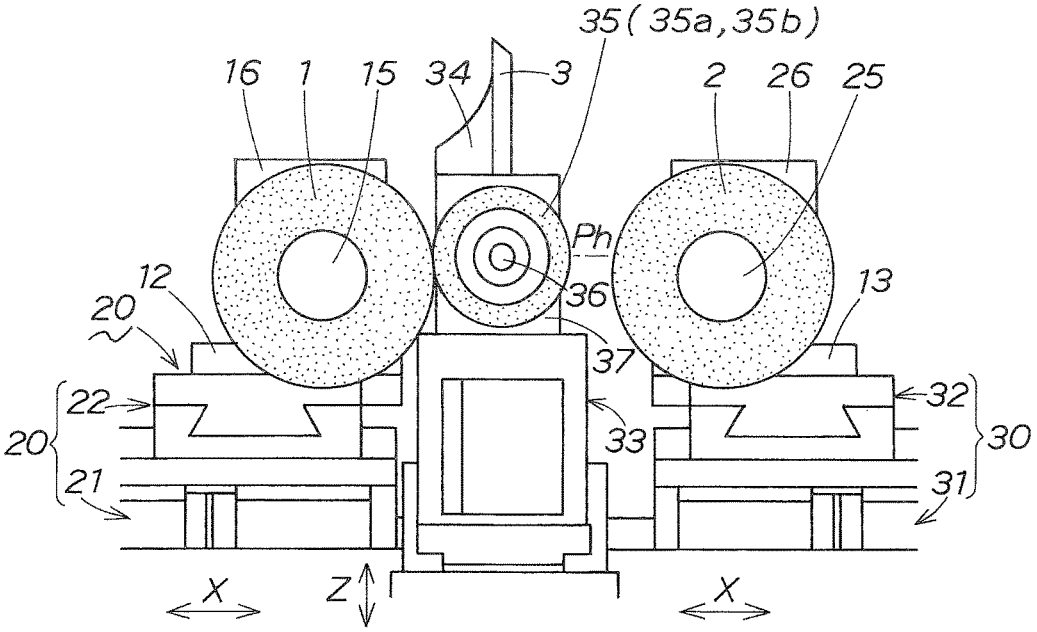
FIG. 5B is an enlarged front view showing the dressing unit of the centerless grinding machine in a dressing state during dressing (during dressing of a grinding wheel).

When the dresser 35 is located at the dressing position Ph shown in FIG. 5B, the grinding wheel 1 and the regulating wheel 2 are dressed by the dresser 35 at the dressing position Ph according to a movement of the dresser 35 relative to the grinding wheel 1 and the regulating wheel 2 in the longitudinal axial direction.

In the illustrated embodiment, the grinding wheel spindle case 16 and the regulating wheel spindle case 26 are movable in longitudinal axial direction X and lateral feeding direction Y on the bed 11 via the grinding wheel sliding unit 20 and the regulating wheel sliding unit 30, respectively. Thus, the dresser 35 of the dressing unit 4 in an ordinary state is located at the standby position Po under the grinding wheel 1 and the regulating wheel 2 and therebetween as shown FIG. 1. During dressing, the dresser 35 moves up to at least the axial height of the grinding wheel 1 and the regulating wheel 2, that is, the dressing position Ph, and the dresser 35 simultaneously or separately dresses the grinding surface of the grinding wheel 1 and the rotationally supporting surface of the regulating wheel 2 while axially traversing relative to the grinding wheel 1 and the regulating wheel 2 along with cooperation with a movement of the grinding wheel 1 and the regulating wheel 2 in the longitudinal axial direction X.

A specific support structure of dressing unit 4 is, as described above, disposed on the vertical slide 33 with the blade 3 supporting work W, at the lower position between the grinding wheel 1 and the regulating wheel 2. The dressing unit 4 is disposed at the front side position of the vertical slide 33 and the blade 3 is disposed at the rear side position of the vertical slide 33.

The vertical slide 33 is disposed on the bed 11 so as to vertically reciprocate relative to the bed 11. Thus, the dressing unit 4 and the blade 3 disposed on the vertical slide 33 are vertically moved according to a movement of the vertical slide 33.

A feeding operation (elevating operation) of the vertical slide 33 is performed by a feeding means disposed in the sliding unit, which comprises a guide unit, a feed screw unit and a driving motor acting as a drive source, although not shown specifically. The driving motor is electrically connected to the control device 5.

The dressing unit 4 includes, as dresser 35, a rotary diamond, that is, a rotary dresser having a cylindrical dressing surface formed by bonding diamond abrasive grain with a bonding material. In the illustrated embodiment, the dresser 35 includes a pair of rotary dressers: grinding wheel dresser 35*a* and regulating wheel dresser 35*b*.

Figure 6:
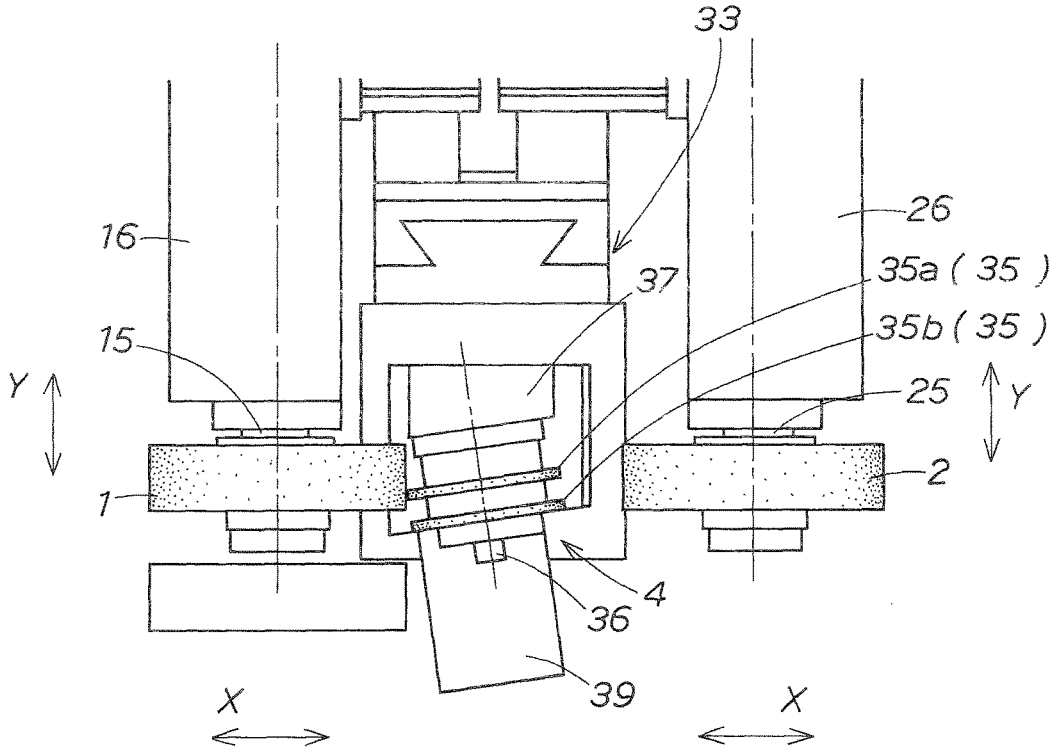
FIG. 6 is an enlarged plan view showing the dressing state of the dressing unit.

Specifically, as shown in FIG. 6, dresser shaft 36 of the dressing unit 4 is horizontally slanted with respect to the axes of the grinding wheel 1 and the regulating wheel 2, and the grinding wheel dresser 35*a* for dressing the grinding wheel 1 and the regulating wheel dresser 35*b* for dressing the regulating wheel 2 are axially mounted with a predetermined spacing on the leading end of the dresser shaft 36 (cantilever structure). The grinding wheel dresser 35*a* and the regulating wheel dresser 35*b* are located so as not to interfere with a dressing operation each other.

The dresser shaft 36 horizontally slanted relative to the axes of the grinding wheel 1 and the regulating wheel 2 is pivotally supported by dresser shaft case 37, which is fixed to the front side position of the vertical slide 33, so as to rotate in the horizontal direction. Moreover, the dresser shaft 36 is brought into driving engagement with driving motor 39, which rotationally drives the dresser shaft 36, via a driving transmission mechanism (not shown). The driving motor 39 is electrically connected to the control device 5.

The driving motor 39 in the illustrated embodiment is replaceable with, for example, a built-in motor (not shown) provided in the dresser shaft case 37 as a direct drive structure. Downsizing and simplification of the driving mechanism leads to space saving of the dresser shaft case 37.

The rotary dresser 35 (the grinding wheel dresser 35*a*, the regulating wheel dresser 35*b*) simultaneously or separately dresses the grinding surface of the grinding wheel 1 and the rotationally supporting surface of the regulating wheel 2 by means of rotational driving of the driving motor 39.

Figure 7:
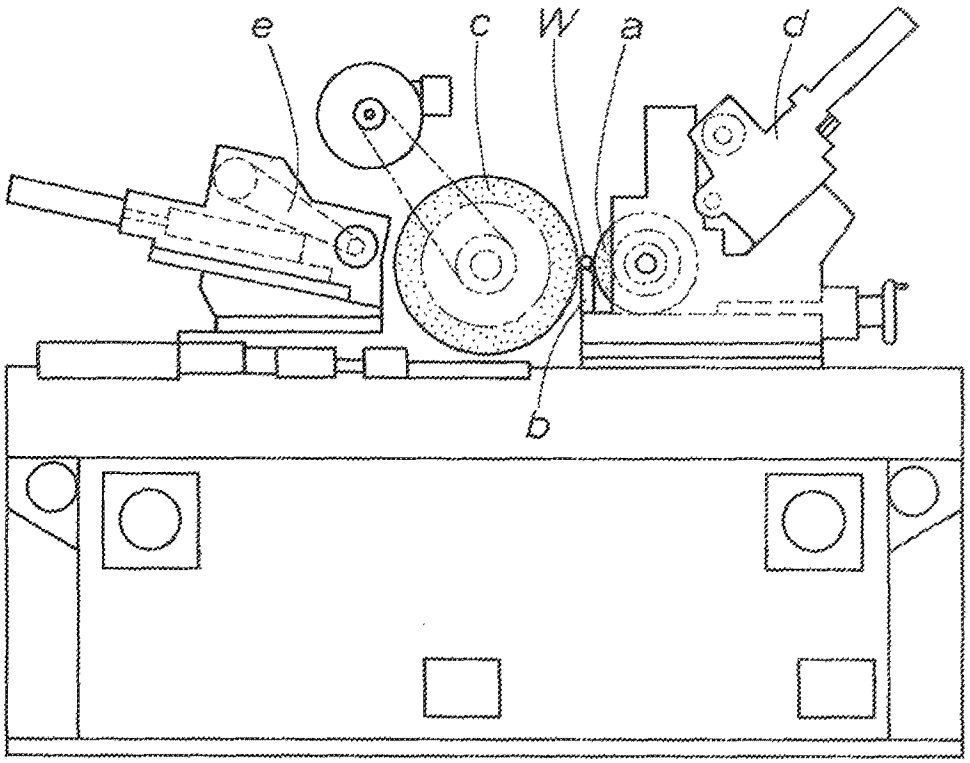
FIG. 7 PRIOR ART
FIG. 7 is a front view showing the whole configuration of a conventional centerless grinding machine.

Specifically, the dresser shaft 36 is slanted as described above and thus the single dressing unit 4 can be provided with grinding wheel dresser 35*a* and regulating wheel dresser 35*b*. In other words, the same function can be provided as the conventional centerless grinding machine shown in FIG. 7 where dressing unit for exclusive use of each of the grinding wheel 1 and the regulating wheel 2 is provided for the grinding wheel land the regulating wheel 2, respectively. Thus, grinding wheel 1 and regulating wheel 2 can be simultaneously or separately dressed by two rotary dressers 35*a*, 35*b*.

In the present embodiment, coolant tank 40 for supplying and collecting coolant to and from a grinding section has the function of a part of local cover 50 that covers the grinding section (grinding room).

Specifically, in a conventional centerless grinding machine, a coolant tank is separately disposed outside of the grinding machine, whereas in the present embodiment, the coolant tank 40 has the function of a part of local cover 50 covering the grinding section or the grinding room, and thus the coolant tank 40 can be disposed in the centerless grinding machine, leading to space saving of the machine.

In addition to the above configuration, the grinding wheel 1 and the regulating wheel 2 are disposed like an overhang in one direction (to the front of the machine in the embodiment shown in FIGS. 2, 3, and 4) from the grinding wheel spindle case 16, the regulating wheel spindle case 26 and the vertical slide 33.

The grinding section disposed like an overhang is divided by partition wall 60 into a mechanism section including the grinding wheel spindle case 16, the regulating wheel spindle case 26 and the vertical slide 33, and a drive section including the motor. The grinding section is covered with the local cover 50 and is stored in grinding room A, and the mechanism section and the drive section are covered with whole cover 61 and are stored in machine room B. Thus, the grinding section in contact with grinding or processing coolant is limited and isolated from the mechanism section and the drive section (isolation of grinding room A and machine room B).

The control device 5 is for automatically controlling by mutually interlocking drive sources of sections constituting the centerless grinding machine, and is in the form of a control panel 55 disposed in the machine pedestal 10.

In a conventional centerless grinding machine, a control panel or operating panel including a control device is separately disposed outside of a grinding machine, and a sub operating panel connected to the operating panel is disposed at least in the machine, whereas in the present embodiment, the control panel 55 disposed on machine pedestal 10 includes the control device 5 and is configured to perform all kinds of control, thereby omitting a sub control panel and its associated equipment that are essential in the conventional machine. This can save the space and the manufacturing cost of the machine.

Specifically, the control device 5 is a CNC unit composed of a microcomputer including CPU, ROM, RAM and I/O port and others.

For the control device 5, a control program for executing the grinding process, a control program for executing the dressing process, a control program for adjusting the center height of work W, and a control program for adjusting the amount of dresser diamond movement of dressing unit 4 are optionally inputted and set as numeric control data beforehand or using the keyboard of control panel 55 on the machine pedestal 10.

The centerless grinding machine configured thus achieves various unique effects as follows:

(a) The dressing means for performing the dressing process of the grinding wheel 1 and the regulating wheel 2 comprises the single dressing unit 4. The dressing unit 4 is located at a lower position between the grinding wheel 1 and the regulating wheel 2, and thus eliminates the need for right and left dresser spaces for grinding wheels that have most seriously affected the breadthwise dimension of a conventional centerless grinding machine, leading to space saving and a considerable reduction in the breadthwise dimension of the centerless grinding machine.

This configuration is suitably used in a small installation space and makes it possible to provide a small desktop centerless grinding machine that can be installed in quite a small installation space, for example, particularly on an office desk.

(b) The dressing unit 4 is disposed at a lower position between the grinding wheel 1 and the regulating wheel 2 so as to dress the grinding wheel 1 and the regulating wheel 2 at the grinding position of work W(=dressing position Ph). This suppresses a change in dimensions caused by a thermal displacement during the grinding of the grinding wheel 1 and the regulating wheel 2, thereby improving grinding accuracy.

Specifically, if the position of dressing performed by the dressing unit 4 on the grinding wheel 1 and the regulating wheel 2 is separated or different from the position of grinding performed by the grinding wheel 1 and the regulating wheel 2 on work W, a grinding or processing environment (particularly an ambient temperature) during dressing on the grinding wheel 1 and the regulating wheel 2 is different from a grinding or processing environment during an operation of the grinding wheel 1 and the regulating wheel 2, that is, during grinding. Consequently, predetermined shape and size of the grinding wheel 1 and the regulating wheel 2 dressed by the dressing unit 4 are affected by a change in dimensions caused by a thermal displacement during actual grinding, thereby reducing grinding accuracy.

Thus, as described above, the grinding wheel 1 and the regulating wheel 2 are dressed at the grinding position of work W(=dressing position Ph), so that a grinding or processing environment during dressing can be identical to that during grinding.

Consequently, predetermined shape and size of the grinding wheel 1 and the regulating wheel 2 dressed by the dressing unit 4 are not affected by a change in dimensions caused by a thermal displacement during actual grinding, thereby keeping desired grinding accuracy.

(c) The dressing unit 4 is disposed on the vertical slide 33 with the blade 3 supporting work W, at a lower position between the grinding wheel 1 and the regulating wheel 2, and the vertical slide 33 can vertically reciprocate relative to the bed 11. The operation of the vertical slide 33 can be automatically controlled so as to adjust the center height of work W, which has been manually adjusted in the conventional machine, and adjust the amount of dresser diamond movement of the dressing unit 4 under numerical control. Thus, a changeover time can be shortened and highly advanced changeover can be achieved.

(d) The control device 5 for controlling by mutually interlocking the drive sources of the components of the grinding machine is disposed in machine pedestal 10 and thus the control panel 55, which is disposed the outside of the apparatus in the conventional centerless grinding machine, can be installed in the space of the grinding machine (the inside of the apparatus).

(e) The coolant tank 40 for supplying and collecting coolant to and from the grinding section has the function of a part of the local cover 50 for covering the grinding unit, and thus the coolant tank 40 can be disposed in the space of the centerless grinding machine.

(f) The control device 5 and the coolant tank 40 are stored in the space of the grinding machine, thereby reducing of the installation space, namely, space saving can be promoted.

(g) The grinding wheel 1 and the regulating wheel 2 are disposed like an overhang in one direction (to the front direction) from the grinding wheel spindle case 16, the regulating wheel spindle case 26 and the vertical slide 33, and are covered with the local cover 50 for covering the grinding section. Thus, the grinding section in contact with grinding or processing coolant is limited and isolated into the grinding room A.

Consequently, the mechanism section comprising the grinding wheel spindle case 16, the regulating wheel spindle case 26 and the vertical slide 33, and the drive section including the motor are stored in the machine room B isolated from grinding room A.

Thus, coolant is unlikely to come in contact with the mechanism section and the drive section, thereby increasing the life of the machine and eliminating the need for a waterproof construction for machine room B. This reduces the manufacturing cost and thus leads to lower machine cost.

(h) The grinding wheel 1 and the regulating wheel 2 are disposed like an overhang from to the front direction from the grinding wheel spindle case 16, the regulating wheel spindle case 26 and the vertical slide 33, and the dressing unit 4 is disposed at a lower position between the grinding wheel 1 and the regulating wheel 2. Thus, all operations for grinding and dressing can be performed at the front of the grinding machine substantially without movements, thereby remarkably improving operability and preparation.

Incidentally, the described-above embodiment is just a preferred embodiment of the present invention, and the present invention is not limited to this embodiment. It is possible to change the design in various ways within the scope of the invention.

(1) In the illustrated embodiment, a cantilever structure is used in which the grinding wheel 1 and the regulating wheel 2 are mounted on the leading ends of the grinding wheel spindle 15 and the regulating wheel spindle 25, respectively. The grinding wheel 1 and the regulating wheel 2 may be mounted at the center of the grinding wheel spindle 15 and the regulating wheel spindle 25 in the axial direction (dual supported structure).

(2) In the illustrated embodiment, the driving motor 18 of the grinding wheel 1 and the driving motor 28 of the regulating wheel 2 are disposed in parallel outside the grinding wheel spindle case 16 and the regulating wheel spindle case 26. These external driving motors 18, 28 may be replaced with built-in motors as a direct drive structure depending on the purpose. Such a small and simple driving mechanism can achieve space saving and reduce vibrations of the grinding wheel spindle case 16 and the regulating wheel spindle case 26.

(3) In the illustrated embodiment, the grinding wheel spindle case 16 and the regulating wheel spindle case 26 are longitudinally moved for dressing. Alternatively, the dresser 35 may have a longitudinal moving mechanism for dressing. In this case, the grinding wheel longitudinal slide 22 of the grinding wheel sliding unit 20 and the regulating wheel longitudinal slide 32 of the regulating wheel sliding unit 30 can be omitted, thereby eliminating one movement axis.

(4) In the illustrated embodiment, the grinding wheel dresser 35*a* for dressing the grinding wheel 1 and the regulating wheel dresser 35*b* for dressing the regulating wheel 2 are axially mounted with a predetermined spacing on the leading end of the dresser shaft 36 in a cantilever structure. The cantilever structure may be replaced with a dual supported structure where the pair of dressers 35*a*, 35*b* is mounted at the center of the dresser shaft 36 in the axial direction.

(5) In the illustrated embodiment, the rotary dresser (rotary diamond) 35 may be replaced with a point diamond dresser (point diamond) whose end chip is made of diamond. In this case, at the right and left sides of the dresser shaft case 37, the point diamond dresser is fixed at a position corresponding to the periphery of the cylinder of each of the grinding wheel 1 and the regulating wheel 2, which is not specifically illustrated.

(6) In the case of the centerless grinding machine in the illustrated embodiment, work W to be machined is relatively small in shape and size, and the machine has a space-saving structure. The configuration of the present invention is most suited for a centerless grinding machine having such a space-saving structure in particular. Naturally, it is also possible to achieve such space saving by applying the present invention to a large-sized centerless grinding machine for grinding work W that is large in shape and size.

(7) The centerless grinding machine in the illustrated embodiment can be applied to all types of centerless grinding machines irrespective of the grinding systems such as a through-feed grinding system or an in-feed grinding system.

(8) In the illustrated embodiment, the configurations of the driving systems of the units constituting the centerless grinding machine may be optionally replaced with the configurations of the driving systems of the related art, which is not specifically shown, depending on the purpose.

The specific example mentioned in the detailed description of the present invention is just intended to make clear the technical detail of the present invention. Accordingly, the present invention is not limited to the specific example, and it should not be taken in a narrow sense but in a broad sense such that it can be changed in various ways within the spirit of the present invention and the scope of the claims.

What is claimed is:

1. A centerless grinding machine for centerless grinding of a periphery of a work by means of a grinding wheel rotationally driven while rotationally supporting the work with a regulating wheel and a blade, comprising:

a dressing means for performing a dressing process of the grinding wheel and a dressing process of the regulating wheel, wherein the dressing means comprises a single dressing unit disposed between and at a lower position than the grinding wheel and the regulating wheel, wherein the dressing unit includes a dresser vertically movable between a standby position and a dressing position, and wherein the dresser is moved in a longitudinal axial direction relative to the grinding wheel and the regulating wheel so as to dress the grinding wheel and the regulating wheel at the dressing position.

2. The centerless grinding machine of claim 1, further comprising:

a grinding wheel spindle case for pivotally supporting the grinding wheel so as to rotationally drive the grinding wheel and a regulating wheel spindle case for pivotally supporting the regulating wheel so as to rotationally drive the regulating wheel, wherein the grinding wheel spindle case and the regulating wheel spindle case are disposed on a bed so as to move at least in a lateral feeding direction via a grinding wheel sliding unit and a regulating wheel sliding unit, respectively, the bed being disposed on a machine pedestal.

3. The centerless grinding machine of claim 2, wherein the dressing unit arranged opposite the grinding wheel spindle case and the regulating wheel spindle case with respect to the grinding wheel and the regulating wheel.

4. The centerless grinding machine of claim 3, wherein the grinding wheel spindle case and the regulating wheel spindle case are disposed on the bed so as to move in the longitudinal axial direction and the lateral feeding direction via the grinding wheel sliding unit and the regulating wheel sliding unit, respectively, the bed being disposed on the machine pedestal, and the dresser of the dressing unit is configured to dress the grinding wheel and the regulating wheel at the dressing position along with cooperation with a movement of the grinding wheel and the regulating wheel in the longitudinal axial direction.

5. The centerless grinding machine of claim 3, wherein the dressing unit and the blade are disposed on a vertical slide with the blade supporting the work, the dressing unit and the blade being arranged between and at a lower position the grinding wheel and the regulating wheel, wherein the vertical slide is capable of vertically reciprocating relative to the bed so as to vertically move the dresser of the dressing unit.

6. The centerless grinding machine of claim 5, further comprising:

a coolant tank for supplying and collecting coolant to and from a grinding section, and a local cover for covering the grinding section, wherein the coolant tank forms a part of the local cover, the grinding section is constituted of the grinding wheel and the regulating wheel, the grinding wheel and the regulating wheel constituting the grinding section are disposed like an overhang from the grinding wheel spindle case and the regulating wheel spindle case such that the grinding wheel and the regulating wheel are arranged in front of all of the grinding wheel spindle case, the regulating wheel spindle case, and the vertical slide, and the local cover covers the grinding section such that the grinding section and the coolant are isolated from the grinding wheel spindle case, the regulating wheel spindle case, and the vertical slide by the local cover.

7. The centerless grinding machine of claim 3, wherein the dressing unit includes a dresser shaft slanted with respect to axes of the grinding wheel and the regulating wheel, wherein the dresser shaft has a grinding wheel dresser for dressing the grinding wheel, and a regulating wheel dresser for dressing the regulating wheel, wherein the grinding wheel dresser is located such that it does not interfere with a dressing operation of the regulating wheel dresser, and the regulating wheel dresser is located such that it does not interfere with a dressing operation of the grinding wheel dresser.

8. The centerless grinding machine of claim 2, wherein the machine pedestal has a control device for controlling drive sources of components of the grinding machine.

9. The centerless grinding machine of claim 1, further comprising:

a coolant tank for supplying and collecting coolant to and from a grinding section, and a local cover for covering the grinding section, wherein the coolant tank forms a part of the local cover.

* * * * *